United States Patent [19]

Weeks

[11] Patent Number: 4,597,202

[45] Date of Patent: Jul. 1, 1986

[54] V-SHAPED HIGHWAY SNOW PLOWS

[75] Inventor: Warran D. Weeks, Kalamazoo, Mich.

[73] Assignee: Root Spring Scraper Company, Kalamazoo, Mich.

[21] Appl. No.: 673,679

[22] Filed: Nov. 21, 1984

[51] Int. Cl.[4] ..... E01H 5/06

[52] U.S. Cl. ..... 37/232; 37/272; 172/816

[58] Field of Search ..... 37/232, 266, 273; 172/815, 816, 817

[56] References Cited

U.S. PATENT DOCUMENTS

| | | | |
|---|---|---|---|
| 2,290,060 | 7/1942 | Massey | 37/232 X |
| 3,436,847 | 4/1969 | Grimes | 37/272 X |
| 3,604,131 | 9/1971 | Bogenschutz et al. | 37/232 |
| 3,626,614 | 12/1971 | Kahlbacher | 37/232 |
| 3,650,054 | 3/1972 | Hanson | 37/232 |
| 4,159,584 | 7/1979 | Niemela | 37/273 X |
| 4,259,794 | 4/1981 | Rath | 37/232 X |

FOREIGN PATENT DOCUMENTS

| | | | |
|---|---|---|---|
| 331751 | 11/1935 | Italy | 37/272 |
| 588438 | 11/1933 | United Kingdom | 37/273 |
| 975035 | 11/1964 | United Kingdom | 37/266 |

*Primary Examiner*—Edgar S. Burr
*Assistant Examiner*—Moshe I. Cohen
*Attorney, Agent, or Firm*—Austin A. Webb

[57] ABSTRACT

A V-shaped under frame with a transverse rear member connected at its ends to forwardly converging side members has spaced uprights connectable to a truck. Pivots connected in aligned relation on each side member connect to ribs on the convex rear side of right and left moldboards. The inner edges of the moldboards are closely adjacent along their upper portions, but diverge along their lower portions. Backing springs on the side members bias the tops of the moldboards forwardly. A low V-shaped plow point is connected by a strut to the under frame and located within the space left by the diverging lower portions of the moldboards. Roadway engaging shoes are connected to the under frame adjacent each of its three corners.

9 Claims, 4 Drawing Figures

V-SHAPED HIGHWAY SNOW PLOWS

DETAILED DESCRIPTION

The drawings, of which there are 2 sheets, disclose a preferred form of the plow of the invention.

OUTLINE OF INVENTION

Highway snow plows with forwardly converging moldboards are well known, but as far as is known, these have always had the moldboards rigidly connected in V-shaped arrangement. When these rigid V plows encounter a rigid obstruction in the roadway the entire plow, and the driving truck, must be deflected laterally along the side of the plow which strikes the obstruction; or some part must break. In either case, the plow and truck are stalled. The present invention pivots each of these two moldboards separately to the under frame on which they are mounted. Due to the forwardly projeting lower inner edges of the moldboards, which are forwardly concave, it is necessary to cut or bevel back the lower corners so that when one blade pivots back at the bottom it will clear the other blade. This leaves a V-shaped gap in the center of the plow which would leave an unplowed ridge of snow in the center of the swath cleared by the plow. It is an incident or corollary of the invention that a low narrow plow point is connected rigidly to the under frame of the plow to substantially fill the gap left by the cut away lower front corners of the two moldboards. The separately pivoted moldboards are each biased forwardly and down to the roadway by their own spring mounted on the converging side members of the under body or frame of the plow.

DETAILED DESCRIPTION

A truck for driving the plow is indicated in phantom at 10. The plow has an under body or frame generally indicated at 12 and consisting of converging side members 14 connected at their rear ends by a transverse rear member 16. Uprights 18 on the rear member are adapted to be removably connected to the truck and plow elevating mechanism thereon. Suitable cross bracing between the parts of the under frame is indicated at 20. Cylindrical supports 22 are mounted at the corners of the under frame for roadway engaging shoes 24 to prevent the plow from digging into the roadway. All of these parts are generally old and well known and so are not described in greater detail.

Figure 1:
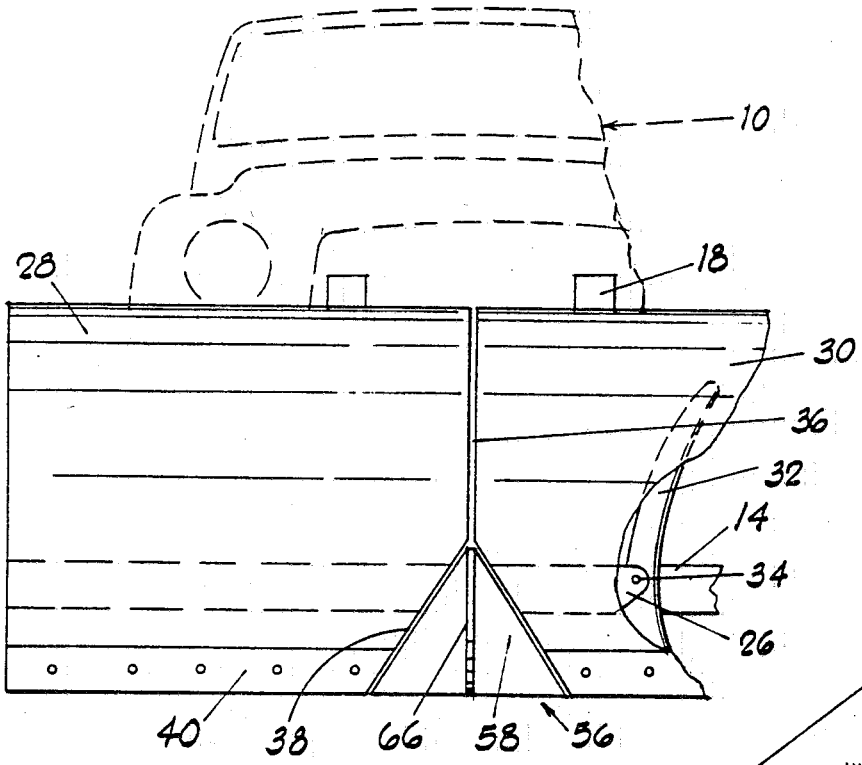
FIG. 1 is a fragmentary front elevational view of the plow, with a driving truck shown in phantom.

Secured to and projecting forwardly from the side members 14 are pairs of spaced pivot ears 26 which define alined pivot axes along each side member. Right and left moldboards 28 and 30 are forwardly concave and have ribs 32 on their back sides which fit between the ears of each pair and are connected thereto by pivot pins 34. The pivots support the two moldboards with the upper portions of their inner edges closely adjacent as at 36 in FIG. 1. The lower front corners of the moldboards are cut away or bevelled as at 38. The moldboards are provided with replaceable wear blades 40, as is common.

Figure 4:
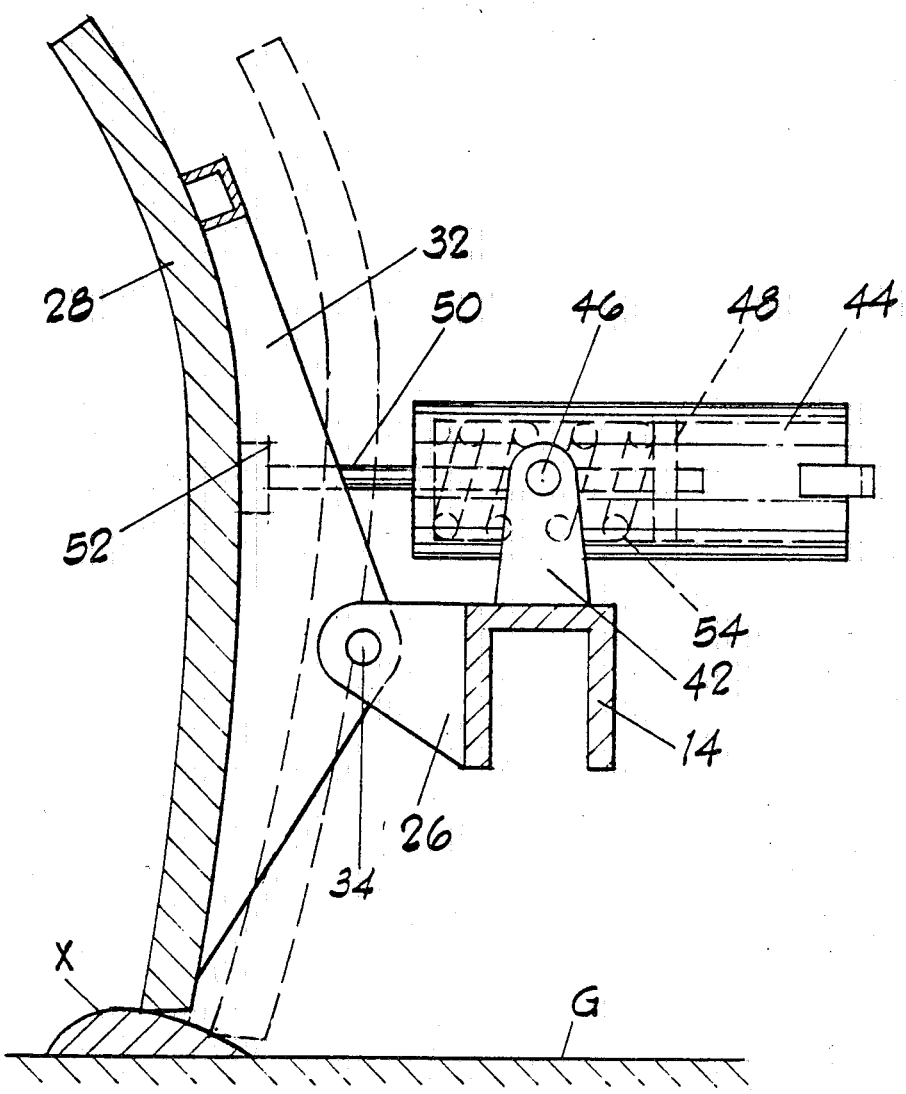
FIG. 4 is a further enlarged cross sectional view of the plow taken along the plane of the line 4—4 in FIG. 2.

Secured to the tops of the side members 14 are spaced upstanding plates 42 between which cylindrical spring housings 44 are pivotally mounted by pivots 46. Piston-like plungers 48 with push rods 50 (see FIG. 4) extend forwardly through the ends of the cylinders and connect to the rear sides of the mold boards 30 at 52. Springs 54 within the cylinders are compressed between the piston 48 and the end of the cylinder whenver the lower edge of the moldboard strikes an obstruction X and the side frame member 14 moves forwardly relative to the obstruction. This tilts the moldboard forwardly as indicated by the dotted lines, thus raising the lower edge of the moldboard so that the blade may pass over the low obstructions. Spring backing similar to the one illustrated have been used in the past on single moldboards, one side delivery plows.

Figure 3:
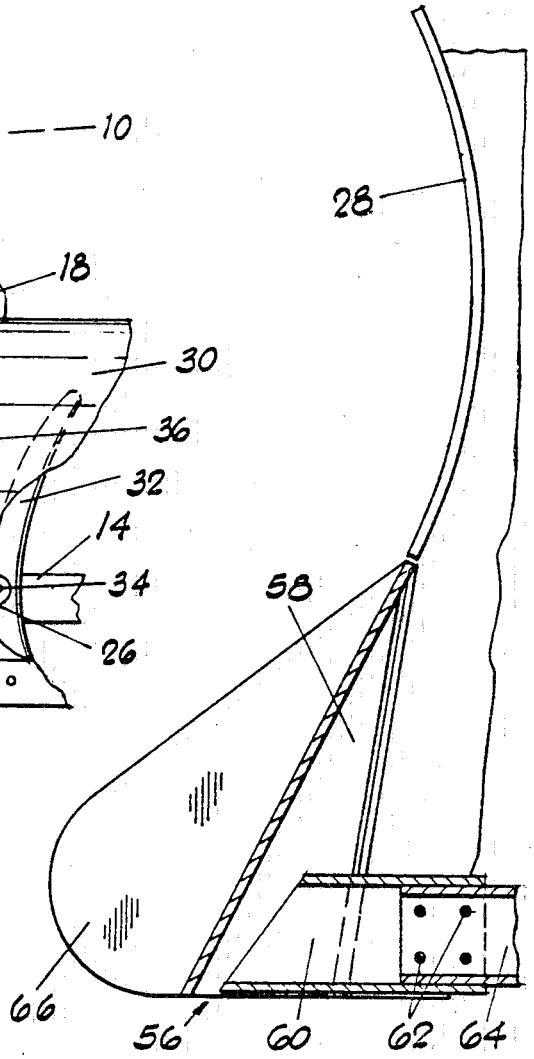
FIG. 3 is an enlarged fragmentary cross sectional view taken along the plane of the line 3—3 in FIG. 2 and showing the center plow point.
Figure 2:
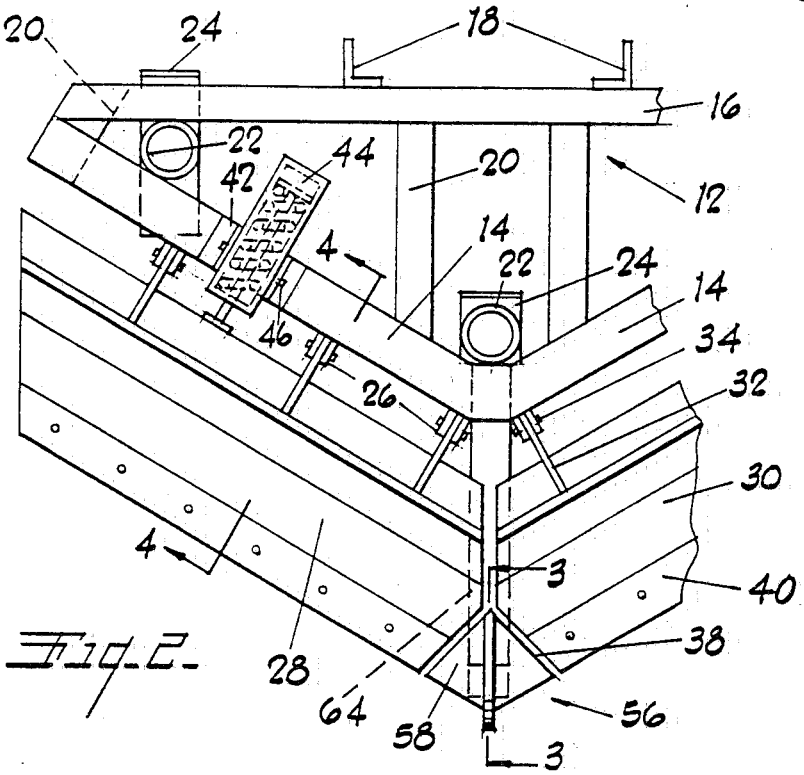
FIG. 2 is a fragmentary top plan view of the plow.

By locating the pivots 34 for the moldboards slightly above the level the tops of the cut aways or bevels 38, clearance of the lower inside corner of the moldboard tilting back over an obstruction relative to the other non-tilting moldboard is assured. This reduces to a minimum the height of the bevels 38 at the inner corners of the moldboards. The triangular gap created by the bevels is filled by a low triangular plow point indicated generally at 56. The point has triangular sides 58 joined as sides of a pyramid. A rectangularly tubular support 60 extends rearwardly from the plow point and is removably connected at 62 (see FIG. 3) to the forward end of a strut 64 which extends rearwardly where it is connected rigidly to the under side of the side members 14 at their apex. This locates the strut above the forward shoe 24. An arcuate nose plate 66 projects forwardly from the junction of the two sides of the plow point. The plate 66 functions to cam the entire plow, including the front of the under frame over low obstructions which the plow may strike dead center.

A similar double tilt action could be obtained by off-setting the line of pivot connections of one moldboard longitudinally relative to the other moldboard on the under frame; but this would entail lengthening the under frame, and therefore is considered less desirable.

What is claimed to be new and what is desired to be secured by Letters Patent is defined in the following claims:

1. A V-shaped highway snow plow having a generally horizontal V-shaped under frame with a transverse rear member connected at its ends to forwardly converging side members and having laterally spaced uprights near the center of the rear member adapted to be connected to a truck, and roadway engaging support shoes depending below the frame, said plow being characterized by having:

alined pivot supports carried by each of said side members, a pair of individual forwardly convex moldboards with pivot connectors on their rear sides mounted on said pivot supports, one moldboard on each side member, said moldboards being mounted independently of each other, a pair of spring abutments carried by said under frame in generally perpendicular relation to said side members, springs anchored by said spring abutments, and pressure members connected to the backs of said moldboards and co-acting with springs to bias the upper edges of said moldboards rearwardly about said pivot connections, the upper portions of the inner edges of said moldboards being biased to normally be in closely adjacent relation by said springs, either of said moldboards upon striking an obstruction, pivoting about its associated pivot support to compress said spring independent of the motion of the other moldboard.

2. A snow plow as defined in claim 1 in which the lower portions of the inner edges of said moldboards are cut away along lines inclined downwardly and transversely outwardly from the center of the plow.

3. A snow plow as defined in claim 2 in which the space between the cut away parts of said moldboards is substantially closed by a low V-shaped plow point rigidly connected to said under frame.

4. A snow plow as defined in claim 3 in which there is a rigid nose plate connected to the apex of said plow point and projecting forwardly therefrom and having a forwardly convex front edge.

5. A snow plow as defined in claim 3 in which one of the support shoes on said under frame is connected to the apex of the under frame rearwardly from said plow point.

6. A snow plow as defined in claim 1 in which said spring abutments on said moldboards are closely adjacent to the level of said pivot supports.

7. A snow plow as defined in claim 2 in which the tops of the cut away parts of said moldboards are approximately at the level of said pivot supports in the working position of the plow.

8. A V-shaped highway snow plow having a generally horizontal V-shaped under frame with a transverse rear member connected at its ends to forwardly converging side members and having laterally spaced uprights near the center of the rear member adapted to be connected to a truck, and roadway engaging support shoes depending below the frame, said plow being characterized by having:

alined pivot supports carried by each of said side members, a pair of said moldboards being mounted independently of each other, forwardly convex moldboards with pivot connections on their rear sides associated with said pivot supports, one moldboard on each side member, a pair of spring abutments carried by said under frame in generally perpendicular relation to said side members, springs achored by said spring abutments, and pressure members connected to the backs of said moldboards and co-acting with spring to bias the upper edges of said moldboards rearwardly about said pivot connections, either of said moldboards upon striking an obstruction, pivoting about its associated pivot support to compress said spring independent of the motion of the other moldboard.

9. A snow plow as defined in claim 8 in which the upper portions of the inner edges of said moldboards are biased to closely adjacent a plane extending vertically and longitudinally across the center of the rear member of said under frame.

* * * * *